US005910267A

United States Patent [19]

Stricker

[11] Patent Number: 5,910,267

[45] Date of Patent: Jun. 8, 1999

[54] INFRARED HEATER

[76] Inventor: Jesse C. Stricker, 780 Vanderville Dr., Fenton, Mo. 63026

[21] Appl. No.: 08/936,499

[22] Filed: Sep. 24, 1997

[51] Int. Cl.[6] ..... H05B 3/10; H05B 3/34

[52] U.S. Cl. ..... 219/548; 219/549; 219/553; 392/418; 392/435; 392/437

[58] Field of Search ..... 219/345, 354, 219/538, 546, 548, 552, 553, 549

[56] References Cited

U.S. PATENT DOCUMENTS

| | | |
|---|---|---|
| 2,889,439 | 6/1959 | Musgrave . |
| 2,938,992 | 5/1960 | Crump . |
| 3,397,301 | 8/1968 | Hager, Jr. . |
| 3,479,490 | 11/1969 | Stark . |
| 3,493,724 | 2/1970 | Wells . |
| 3,564,207 | 2/1971 | Joeckel et al. . |
| 3,664,013 | 5/1972 | MacGuire . |
| 3,694,622 | 9/1972 | Bentley . |
| 3,809,859 | 5/1974 | Wells . |
| 4,017,967 | 4/1977 | Wells et al. . |
| 4,060,710 | 11/1977 | Reuter et al. . |
| 4,321,459 | 3/1982 | Miyahara et al. . |
| 4,602,238 | 7/1986 | Furtek . |
| 4,659,906 | 4/1987 | Furtek . |

*Primary Examiner*—Tu Ba Hoang
*Assistant Examiner*—Thor S. Campbell
*Attorney, Agent, or Firm*—Polster, Lieder, Woodruff & Lucchesi

[57] ABSTRACT

An infrared heating element of the present invention includes a facing (preferably a fiberglass cloth) which is cut to a desired shape and size, an insulating blanket of the same shape and size as the facing, a heating filament sandwiched between the facing and the insulating blanket. The insulating blanket, which is preferably a ceramic fiber blanket, is rigidized by soaking the blanket is a rigidizing solution, such as a colloidal silica solution, The step of rigidizing the blanket provides at least one face of blanket which is impregnated with the rigidizing solution and a core which remains free of rigidizing solution. While the insulating properties of the blanket at the surfaces are reduced by the rigidizing, the insulating properties of the core of the blanket are not substantially affected.

The heating element is included in a portable dryer for use in drying items such as screen printed articles. The dryer includes an adjustable column to selectively alter the height of the heating element of the dryer and a dryer head which is mounted on a carriage to enable the head to be moved between an extended and retracted position. The head is also pivotal relative to the column.

The heating element is also incorporated in a heater unit which may be easily assembled substantially without tools. A plurality of the heater units may be assembled together to form a bank of heater units which are physically and electrically connected. The housing for the units allow for the wires to pass from one unit to another, without exposing the wires externally of the bank of heater units and without the use of wire conduits, and for a plurality of heater units to be connected to a single control or power supply.

20 Claims, 11 Drawing Sheets

INFRARED HEATER

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This application relates to infrared heaters, and in particular to a new and improved heating element which may be incorporated in a portable heater or in a heating unit, a plurality of which may be physically and electrically connected to construct a bank of heaters.

Infrared dryers have been used for a multiplicity of purposes, such as baking, curing, shrink wrapping, etc. To increase the efficiency of infrared dryers and heaters, the heating elements employed in the dryers or heaters were made generally flat. The heating elements used in such dryers or heaters generally include a woven fiberglass cloth or paper (which forms the heating face of the element), an insulating blanket, and a heating element sandwiched between the fiberglass cloth and the insulating blanket. None of these materials has much structural rigidity—that is, they are all quite flexible, as provided. To impart structural rigidity to the heating element, the insulating blanket was soaked in a rigidizing solution, such as a colloidal silica. The fiberglass cloth may also have been rigidized with the solution. As can be appreciated, prior to being soaked in the rigidizing solution, the insulating blanket was "fluffy," had a high void factor, and hence, had good insulating qualities. However, once the blanket is rigidized, the blanket looses its fluffiness and a large percentage of the voids within the blanket. Thus, the blanket looses a significant amount of its insulating qualities in the rigidizing step.

As noted above, such heating elements have been used for drying, baking etc. One area where infrared dryers have been used is in the printing industry, where designs are applied to textiles via screen printing. The heaters that are presently used can be improved upon to make them easier to use. For example, the heaters can be made more flexible with respect to the height of the heating element and the ability to easily locate the heating element at a desired location relative to the textile.

Another area where such heaters are employed is in the painting industry (for example the car painting industry) where heaters are used to dry or bake paint. In an installation where a large item, such as a car, has been painted and the paint needs to be dried or cured, typically, a large number of heating elements are required to apply heat evenly over the entire surface of the painted item. This typically requires a wall of heaters. The available heaters for such uses are not easily assembled together, either physically or electrically. Such a wall of heaters therefore is difficult to assemble. Once such a wall of heaters is assembled, the individual heaters are difficult to control. Therefore, it is difficult to achieve a uniform heat distribution from the bank of heaters.

BRIEF SUMMARY OF THE INVENTION

One object of the present invention is to provide a heating element for use in a heater, wherein the heating element is structurally rigid, but retains the insulating qualities of the insulating blanket.

Another object is to provide a portable dryer in which the vertical and horizontal position of the heating element is easily adjusted.

Another object is to provide a heating unit which may, using a plurality of such units, be assembled into a bank or wall of heating units.

These and other objects will become apparent to those skilled in the art in light of the following description and accompanying drawings.

Briefly stated, an infrared heating element of the present invention includes a facing (preferably a fiberglass cloth or paper) which is cut to a desired shape, an insulating blanket of substantially the same shape as the facing, and a heating filament sandwiched between the facing and the insulating blanket. The insulating blanket, which is preferably a ceramic fiber blanket, is rigidized by applying a rigidizing solution, such as a colloidal silica solution, to the blanket. The step of rigidizing the blanket provides at least one face of blanket which is impregnated with the rigidizing solution and a core which remains free of rigidizing solution. The rigidizing solution impregnates the insulating blanket from between $1/16^{th}$ to ½ of the width of the insulating blanket between the first and second surfaces of the blanket. Although, preferably, the rigidity of the blanket is increased by applying increased amounts of the rigidizing solution to the back (exposed) surface of the blanket, the inner (unexposed) surface of the blanket can also be rigidized. While the insulating properties of the blanket at the surfaces are reduced by the rigidizing, the insulating properties of the core of the blanket are not substantially affected.

To hold the heating filament between the fiberglass cloth and the insulating blanket, a heat resistant refractory cement is applied to the fiberglass cloth prior to placing the filament on the fiberglass cloth. The adhesive is also applied over the filament, so that the adhesive will adhere the insulating blanket to the fiberglass cloth. The adhesive is partially absorbed by the blanket, and thus also serves to help increase the rigidity of the blanket. The rigidity of the blanket can also be increased by using a greater amount of cement. This will increase the amount of cement that is absorbed by the blanket. The fiberglass cloth can also be impregnated with the adhesive to give some structural rigidity to the fiberglass cloth. The exposed surface of the fiberglass cloth can be painted with a high emissivity IR coating after the heating element has been formed.

This heating element can be used in any number of applications, such as in dryers used for drying screen printed fabrics and in heating units which are used to build walls of heaters, such as may be used in a car painting station of an assembly plant.

A portable heater, such as can be used by screen printers includes a base, a stem, and a head at the top of the stem. The height of the column is selectively alterable to adjust the height of the heater head, and the heater includes a tightener to fix the height of the head at a desired level. The head includes a housing and a heating element fixed in the housing. A carriage mounted to a top of the stem, and the head is mounted to a bottom of the carriage to be slideable between an extended and a retracted position. The carriage includes a top member and a bottom member which are slideable relative to each other. The top member has a top surface, side rails extending downwardly from the top surface, and at least one roller rotatably mounted to an inner surface of each side rail. The bottom member has a bottom surface to which the heater head is mounted, a pair of spaced apart side rails extending upwardly from the bottom surface, and a flange extending outwardly from each bottom member side rail. The bottom member flanges ride on the rollers of the top member to allow the heater head to be moved between the extended and retracted positions. A handle extends from the carriage bottom member to facilitate extension and retraction of the head.

The carriage includes a neck which is received in the top of the stem. The neck is received in the stem in a manner to allow the head to rotate about the heater stem. A second handle extends up from the top surface of the carriage to facilitate rotation of the head about the neck of the carriage.

The heater can be provided with a control assembly to which the heating element is connected. The heating element can either be wired directly to the controller or it can include a power cord which plugs into a socket on the control assembly.

To facilitate vertical adjustment of the head, the stem includes a bottom tube extending upwardly from the base and a top tube telescoping from the bottom tube. A tightener, comprising a knob and a set screw, passes through one of the two tubes to bear against the other of the tubes to hold a the head at a desired height. An assembly is provided in the stem to prevent quick movement of the two tubes relative to each other, and to prevent substantial movement of the tubes relative to each other when the tightening knob is loosened. The assembly includes a bar received in the bottom tube and which is fixed in the bottom tube by a pin which extends through the tube and the base of the bar. A coiled spring is journaled about the top of the bar and is held in a desired position relative to the bar by a second pin which extends through the top of the bar and into the coils of the spring. A third pin extends inwardly from the top bar through a second coil of the spring.

As noted, the heating element can also be incorporated in a heating unit, a plurality of which may be assembled together to form a bank or wall of heating units. Each heating unit comprises a housing having an open front, side walls, and a back panel. An infrared heating element is supported in the housing near the housing front. The heating element includes a heating surface, an insulating layer, and a heating filament sandwiched between the heating surface and insulating layer. The heater unit is shaped and adapted to facilitate physical and electrical connection of two or more of the heater units without the use of wire conduits and without exposing any wires which interconnect adjacent heater units. A flange extends inwardly from the walls of the housing spaced slightly rearwardly of the front of the housing. Channel members extend between opposed walls of the housing rearwardly of the flange and define rearwardly facing channels. The channel members each include a front surface spaced rearwardly of the housing flange. The heating elements are positioned against the back side of the flange and are held in place by a layer of insulation which is positioned between the back of the heating element and the front surface of the channel member.

A terminal block is mounted in the heater unit in one of the channels of the unit. The channel members, which include at least one side wall, include wire openings in the front surface and side walls thereof. Further, two sets of knockouts are provided in the heater housing. One set of knockouts are aligned with the channels to communicate with the channels and permit electrical wires to pass between adjacent heating units. The second set of knockouts is provided for bolts which pass through the walls of adjacent units to physically connect the units together. The terminal block in each unit allows for the heating elements to be electrically connected together, and to electrically connect a plurality of heating units. Wire nuts may be used in lieu of the terminal blocks. The provision of the wiring knockouts allows for the electrical connection of the heating units without the wires being exposed externally of the bank of heating units and without the need to use a wire conduit.

A focusing grid can optionally be mounted to the housing against the front surface of the flange. A plurality of slits are provided in the flange of the heater unit. Clips pass through the slits, from the back of the flange to secure the grid to the housing. The clips each include a base and a pair of fingers at the top of the base. The connector extends through the slit in the housing flange, and the fingers are bent over a frame of the focusing grid to secure the focusing grid to the housing.

In a second embodiment of the heater unit, the heater unit side walls extend beyond the back panel of the housing. In this instance, the back panel comprises a cover sized and shaped to close the back of the housing. A wiring channel extends outwardly from the housing back panel and is closed by a channel cover. The wiring channel is defined by opposing side walls, a top wall, and a bottom wall which extend from the housing back panel or cover. The back panel includes openings which communicate with the channel to enable wire leads from the heating element to extend into the channel. At least some of the channel walls are adapted to have openings therein to enable electrical connection of two or more of the heater units. Electrical wires from respective heater units are connected together within the channels of the heater units. In this embodiment, the heating element is placed against the inner surface of the housing flange and the insulating blanket extends from the back of the heating element to the back cover of the housing. The resiliency of the insulating blanket thus holds the heating element in place in the housing. If a focusing grid is used, then the focusing grid is placed against the inner surface of the flange and the heating element is placed against the back surface of the focusing grid. Again, the insulating blanket will hold both the heating element and the focusing grid in place in the housing.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
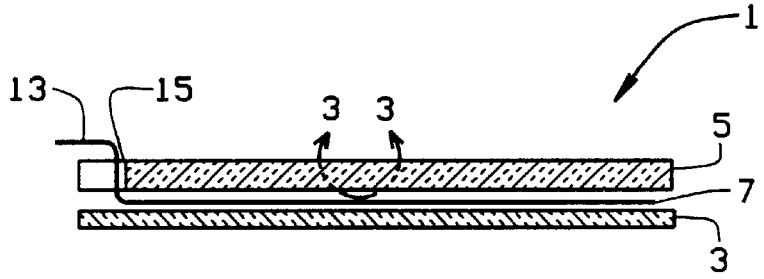
FIG. 1 is an exploded cross-sectional view of a heating element of the present invention.
Figure 2:
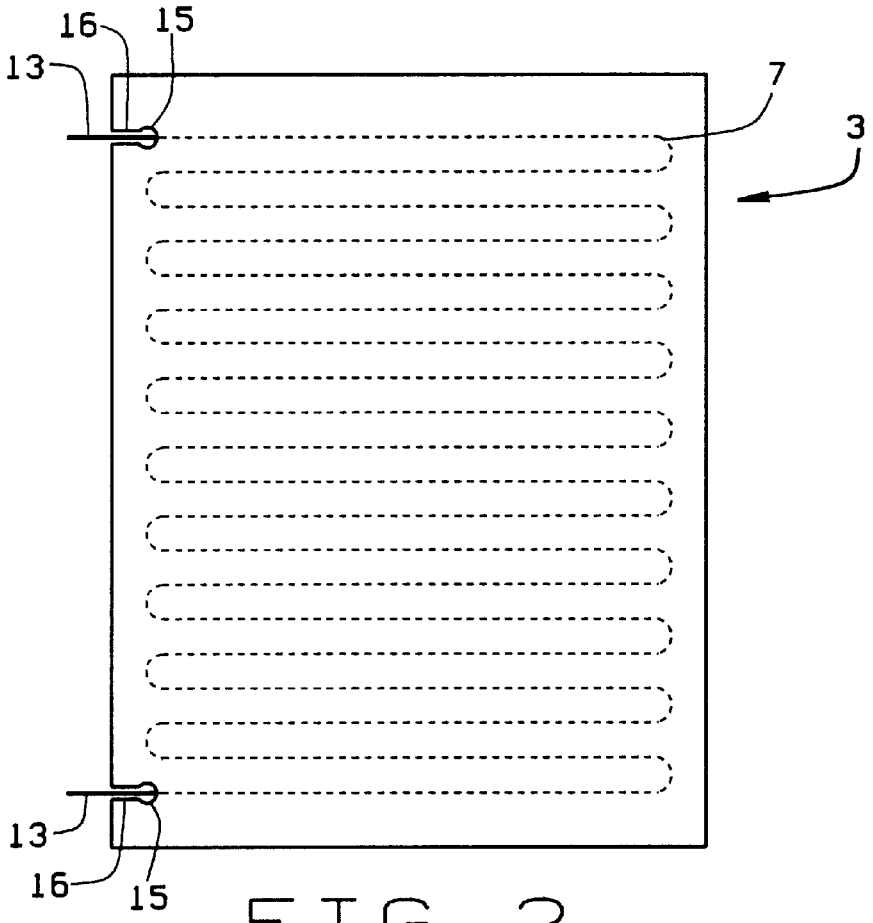
FIG. 2 is a top plan view of the heating element of the present invention.
Figure 3:
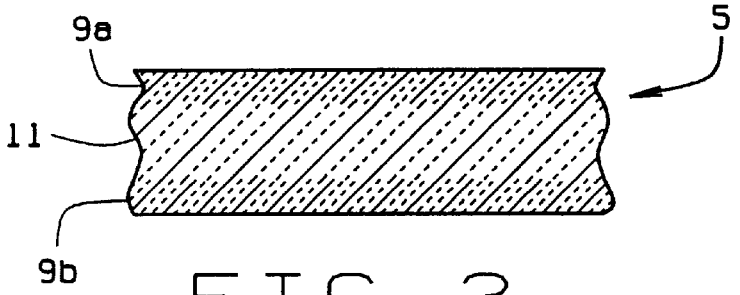
FIG. 3 is an enlarged cross-sectional view of an insulating blanket of the heating element.
Figure 4:
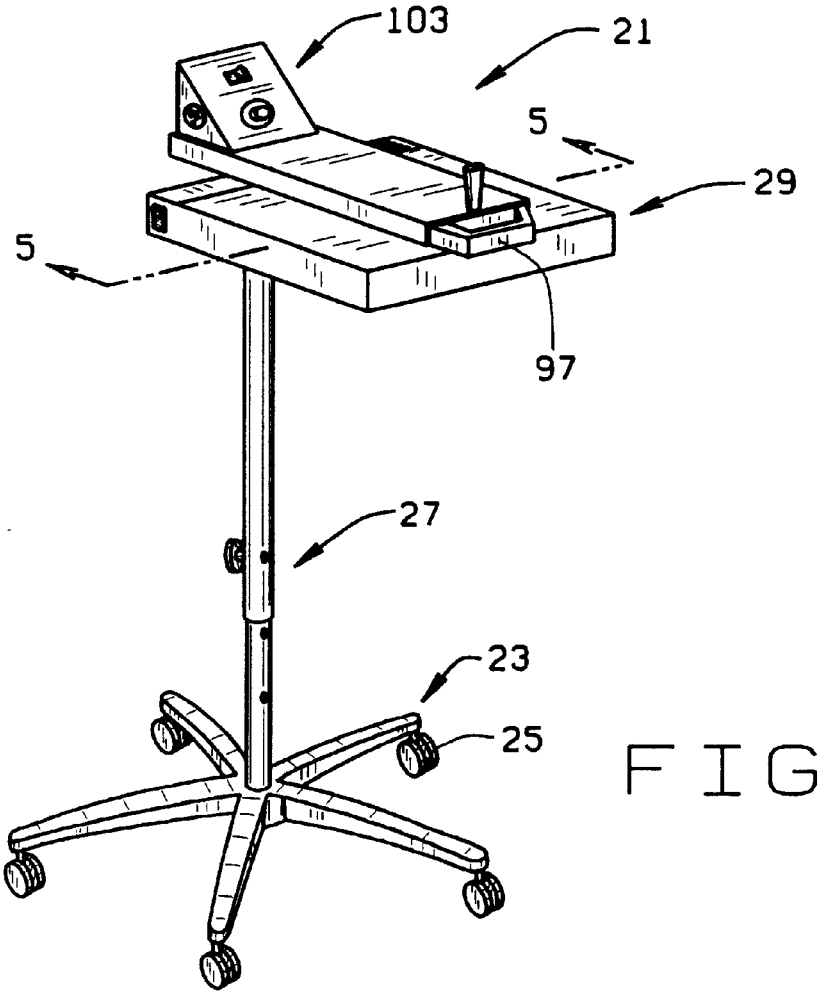
FIG. 4 is a perspective view of a portable heater assembly which incorporates the heating element of FIG. 1.

Turning initially to FIGS. 1–3, a heating element 1 of the present invention includes a front sheet 3, which is preferably a sheet of woven fiberglass cloth, an insulating blanket 5, and a resistance element or filament 7 which is sandwiched between the cloth 3 and the blanket 5. The insulating blanket is chosen for its ability to withstand the heat to which it will be exposed. A preferred blanket is a ceramic fiber blanket, such as is sold under the name DURABLANKET by Unifrax Corp., of Niagara Falls, N.Y.

To produce the heating element 1, one side of the cloth 3 (which will form the heating face of the heating element) is covered with an adhesive, such as a refractory cement, which will withstand the temperatures to which it will be subjected. The refractory cement is preferably a ceramic fiber or refractory fiber such as is available from Unifrax Corp., of Niagara Falls, N.Y. under the name Fiberfrax QF-180 or Fiberfrax QF-150. The Fiberfrax cements contain vitreous aluminosilicate fibers. The resistance element 7 is then applied to the "painted" side of the fiberglass cloth. The resistance wire or element 7 has a desired filament size and wattage, which is chosen for the particular application in which the heating element will be used. The resistance wire 7 is bent into a desired pattern, such as a serpentine pattern, as shown in FIG. 2. However, any desired pattern can be used. Additional adhesive is then applied to the cloth 3 to cover the wire 7. The blanket 5 is then applied to the cloth and wire to cover the wire so that the wire will be sandwiched between the cloth and wire. As can be appreciated, this places the resistance element 7 directly adjacent the cloth 3. The cloth 3 forms the heating surface of the heating element 1. Thus, there is virtually no space between the resistance wire 7 and the heating surface of the heating element 1. Therefore, there is nothing which will impede the transfer of heat from the resistance wire 7 to the heating surface of the heating element 1. This makes the heating element 1 more efficient.

The blanket is applied to the cloth 3 and wire 7 to cover the wire 7. The back surface of the blanket will thus form the back surface of the heating element 1. The blanket is adhered to the cloth 3 and wire 7 by the adhesive which was applied over the wire 7 after the wire 7 had been placed on the cloth 3. To assure a full and proper contact between the insulating blanket 5 and the adhesive which was applied over the heating element 7, the blanket is pressed (preferably gently) such as by hand or with a roller.

After applying the blanket 5 to the cloth and wire, the insulating blanket 5 is rigidized. Prior to rigidizing, the insulating blanket 5 can have a thickness of about ½". To rigidize the blanket, a rigidizing solution is applied to the back or exposed surface of the blanket and is absorbed by the blanket. The solution is preferably a colloidal silica rigidizer, such as is available from Nalco under the product code 1034A. The amount of rigidizing solution applied to the blanket depends on the depth to which the rigidizing solution is to be absorbed. The greater the amount of rigidizing solution that is applied to the blanket, the greater the depth to which it will be absorbed, and the greater the rigidity of the blanket. Preferably, the rigidizing solution is absorbed into the blanket to approximately $\frac{1}{8}^{th}$ to about ½ of the depth of the blanket. This will leave ½ to $\frac{7}{8}^{th}$ of the depth of the blanket free of rigidizing solution. The portion which remains free of rigidizing solution will remain in its original "fluffy" state, and thus will its insulating properties will not be affected. For a ½" blanket, the rigidizing solution is absorbed to approximately 1/16" to about ⅛" deep. The amount of solution that is applied depends on various factors, such as the viscosity of the rigidizing solution and the porosity of the blanket. To make the heating element easier to handle, the edges of the blanket are saturated through and through. This will form, in effect, a narrow border around the blanket which is fully rigidized. This border will help prevent the blanket from fraying and will, as noted, make the blanket and the heating element easier to handle.

I have found that when higher wattage elements (such as $8W/in^2$) are used, the rigidized blanket can warp. To overcome this, when a higher wattage element is used, both faces or surfaces of the insulating blanket are rigidized. The inner (unexposed surface) of the blanket can be rigidized by increasing the amount of adhesive used to adhere the blanket 5 to the cloth 3 and wire 7. The adhesive, although somewhat viscous, is absorbed into the blanket 5. By increasing the amount of adhesive used, the depth to which adhesive is absorbed into the blanket increases, thereby increasing the rigidity of the blanket. Although not preferred, both surfaces of the blanket can be treated with rigidizing solution. This, however requires that a "wet" blanket be applied to the cloth 3 and wire 7. It has been found that to evenly apply the blanket to the cloth and wire when the blanket is wet with rigidizing solution is difficult.

FIG. 3 shows the insulating blanket 5 to have two outer regions 9*a,b* and a middle region 11 which is free of rigidizer. Rigidizer solution is absorbed into the outer region 9*a* and adhesive is absorbed into the region 9*b*. Although the regions 9*a* and 9*b* are shown to be equally impregnated with the respective solution, typically the rigidizing solution will be absorbed more deeply into the blanket than the adhesive.

The middle region 11 remains in its original "fluffy" state and retains the full insulating properties. As can be appreciated, using this method, a better insulating layer is provided. This insulating layer is sufficiently rigid to impart rigidity to the heating element 1, so that the heating element 1 will be rigid.

Once the insulating blanket 5 has been adhered to the cloth and wire, the assembly is allowed to dry. The assembly may be dried by spot heating, or in an oven. Upon drying, the heating element will become rigid and can then be made part of a heater. Once the unit is dry, the face of the element 1 (i.e., the outer surface of the cloth 3) is painted with a high emissivity IR black coating, such as a mixture of black pigment and a rigidizer. The pigment is preferably a metal oxide pigment such as is available from Cerdec under the product name 10333 Black.

As shown in FIG. 1, the leads 13 of the resistance wire 7 extend from holes 15 in the blanket 5. The holes 15 are preferably precut in the blanket, prior to treating the blanket with the rigidizing solution. If desired, the leads 13 can simply extend from the side of the heating element 1. In such a case, the holes 15 would not have to be formed in the blanket 5. Slits 16 (shown exaggerated in FIG. 2) in the blanket 5 can be used in lieu of, or in conjunction with, the holes 15. I have found that it is easier to dry the heating element 1 with the leads 13 extending out the side of the heating element. By placing the slits 16 in the blanket which lead from the holes 15 to the edge of the blanket, the wires can simply be pulled up through the slits once the blanket has dried.

The heating element 1 is sufficiently rigid to be used in many different applications. Because the insulating blanket retains a significant amount of its insulating properties after being rigidized, thinner insulating blankets can be used and still attain the same degree of heat insulation as would be provided by thicker blankets which are fully saturated with rigidizer. This, as can be appreciated, can reduce the manufacturing cost of the heating element.

My novel method of making the heating element 1 also allows for the heating element to be made to have contours (i.e., it can be made to be curved rather than flat). Prior to drying, the heating element is not rigid, rather, it is still highly flexible. The undried heating element can thus be applied to a form or mold prior to drying. When the heating element is dried on the mold, it will retain the shape of the mold once dried. Thus, the heating element can be made in the shape of a baseball cap, for example.

A portable dryer 21 is shown in FIGS. 4–9. The dryer 21 is a dryer such as might be used where a treated item (such as screen printed fabric, small articles, etc.) is placed on a surface to be dried, baked, cured, etc. The dryer 21 includes a base 23 which preferably has rollers 25 to allow the dryer 21 to be easily moved across a floor. A support column or stem 27 extends up from the base 23 and a heating unit 29 is mounted on the top of the stem 27.

Figure 9:
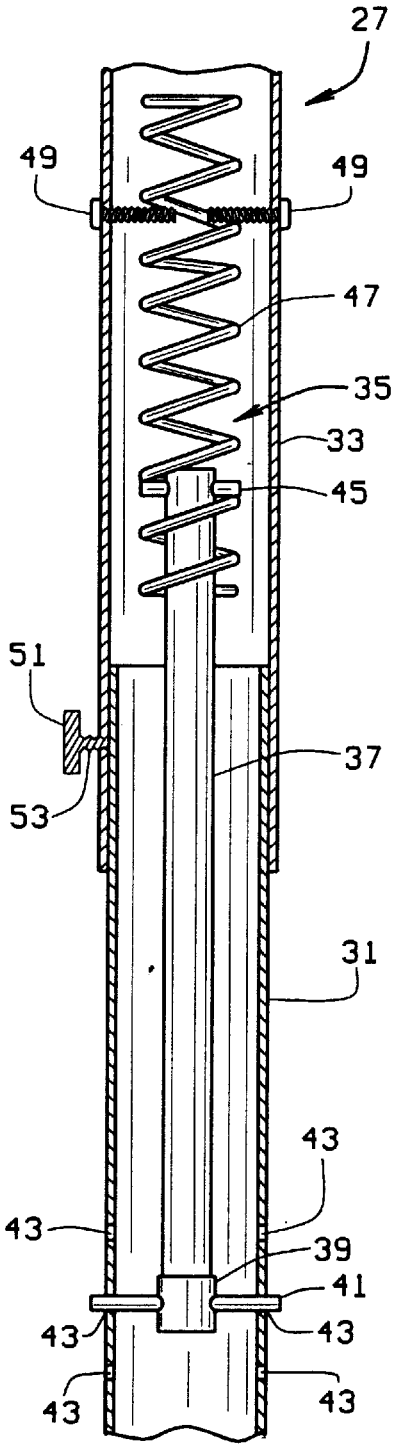
FIG. 9 is a cross-sectional view of the stem of the heater assembly.

Turning to FIG. 9, the stem 27 comprises a hollow bottom tube 31 and a hollow upper tube 33. The two tubes telescope with respect to each other, the tube 33 being shown journaled about the tube 31, such that the upper tube 33 is the "outer" tube. The use of the two telescoping tubes allows for easy adjustment of the height of the heating unit 29. To allow the upper tube 33 to slide more easily over the bottom tube 31, the inner surface of the upper tube 33 is lined with, for example, nylon, which has a low coefficient of friction.

To facilitate positioning of the height of the heating unit 29, the stem has an adjustment assembly 35. The adjustment assembly 35 includes a rod 37 which extends upwardly from a base 39 through the bottom tube 31 and into the upper tube 33. A pin 41 extends radially through the base 39 and passes through openings 43 in the lower tube 31 to positionally fix the assembly 35 with respect to the bottom tube 31. Preferably, more than one set of openings 43 is provided in the tube 31 so that the position of the rod 37 can be altered if desired. A second pin 45 passes radially through the top of the rod 37 to extend into the space inside of the upper tube 33. A coiled spring 47 is journaled around the rod 37, and the pin 45 projects into the coils of the spring 47, as seen in FIG. 9. A pair of pins 49 (shown as bolts in the drawing) project inwardly from the upper tube 33 to pass through the coils of the spring 49. As can be appreciated, the spring 49 will push against the rod pins 45 to bias the upper tube 33 upwardly. To maintain the tubes 31 and 33 in a desired arrangement relative to each other, and to maintain the heating unit 29 at a desired height, a tightening knob 51 and a set screw 53 are provided. The set screw 53, which is rotated by the knob 51, extends through the upper tube 33 to bear against the lower tube 31. By rotating the knob 51 in one direction, the set screw 53 is tightened against the lower tube 31. By rotating the knob 51 in the opposite direction, the screw 53 is drawn out of contact with the lower tube 31, and the upper tube can be raised or lowered to position the heating unit 29 at a desired level. The spring 47 is preferably set to have a tension so that when the knob 51 is loosened, the head 29 of the heater 21 will neither rise nor fall substantially, but rather will remain substantially in the same place.

The use of the pins 45 and 49 which pass through the coils of the spring 47 allows for the tension of the spring to be changed. The spring 47 can be moved axially relative to the rod 37 so that more or less of the spring 47 extends beneath the pin 45. This will tend to expand or compress the spring 47, thereby changing the tension of the spring. The tension of the spring 47 can also be changed by altering the holes 43 through which the pins 41 pass. This will raise or lower the bar 37 relative to the lower and upper tubes, 31 and 33, and, hence, relative to the pins 49, about which the spring is coiled.

Figure 5:
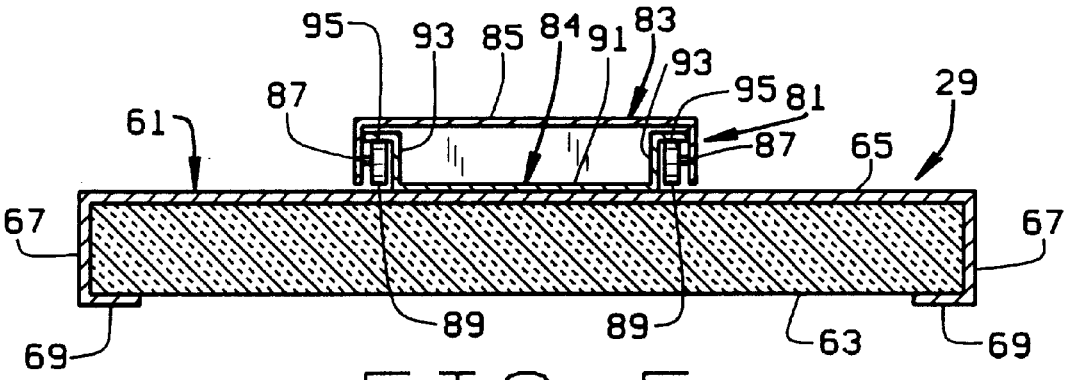
FIG. 5 is a cross-sectional view taken along line 5—5 of FIG. 4.
Figure 6:
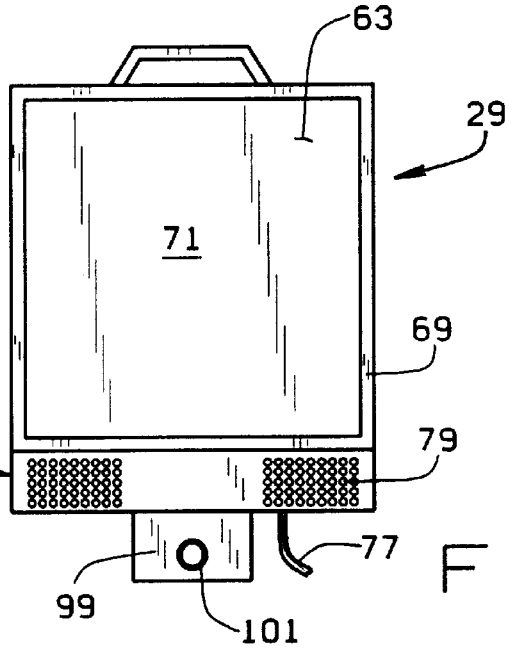
FIG. 6 is a bottom plan view of the heating unit of the heater assembly.
Figure 7:
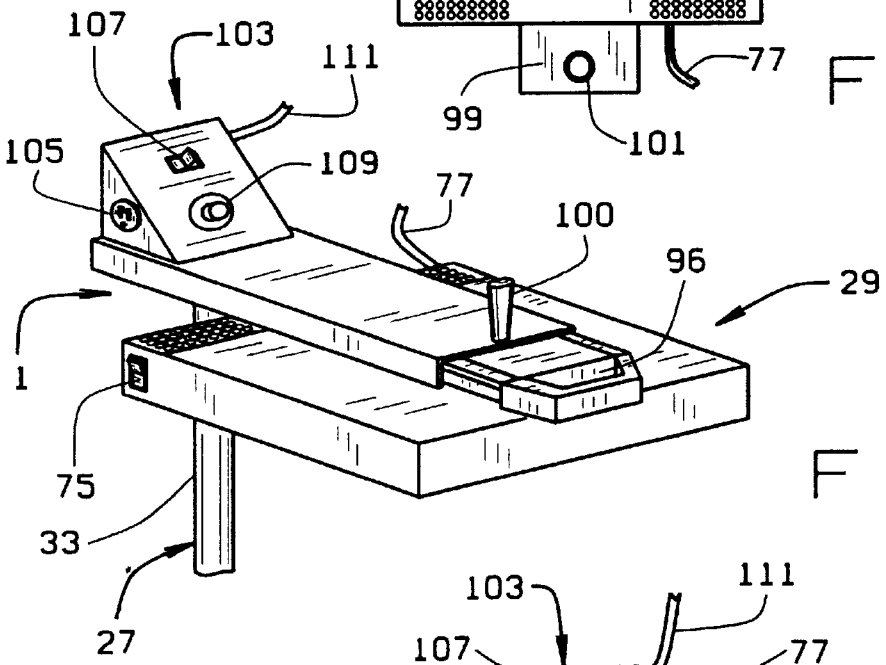
FIG. 7 is a top perspective view of the heating unit, the heating unit being partially extended.
Figure 8:
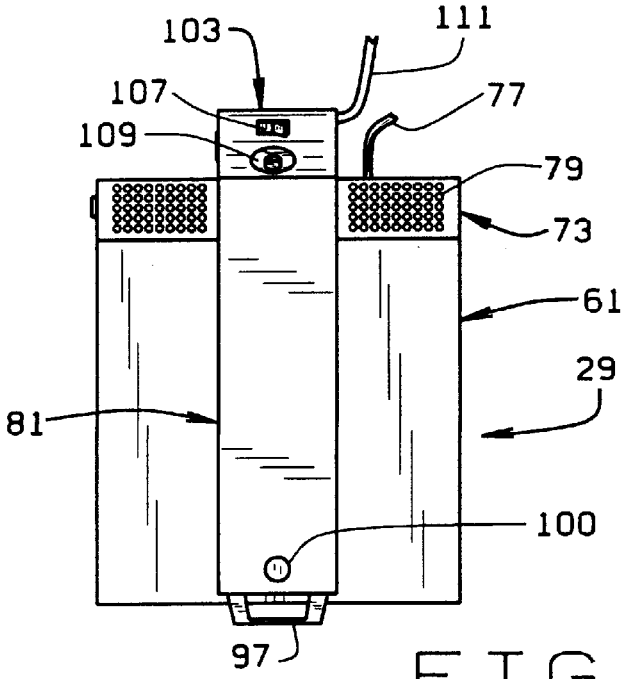
FIG. 8. is a top plan view of the heating unit, the heating unit being in a retracted position.

Turning to FIGS. 5–8, the heating unit 29 includes a housing 61 which houses a heating element 63. Preferably, the heating element 63 is made in accordance with the procedure outlined above. The housing 61 includes a top 65, sides 67, and a lower, inwardly directed flange 69. The flange 69, as seen in FIGS. 5 and 6, define an opening through which the heating face 71 of the heating element 63 is exposed.

An electrical housing 73 (FIG. 8) is formed at the back of the housing 61. The leads of the heating element 63 extend into the housing 73 to be connected to an on/off switch 75, a power cord 77, and a power supply, as may be required. Vent holes 79 are formed in the top and bottom surfaces of the electrical housing 73 to facilitate dissipation of heat built up in the housing 73 during use of the heater 21.

The heating unit 29 is supported below a carriage 81 to enable the heating unit 29 to be moved horizontally. This carriage 81 will allow the head 29 to be selectively moved between a retracted and an extended position. This will facilitate positioning of the head 29 over the workpiece to be dried. It will also enable the operator to use a smaller head to dry a larger item or to extend the head beyond obstacles, such as machinery legs, table ledges, etc.

Thus, the operator does not have to purchase a larger head if a larger item is to be dried. He simply can extend the head across the item to be dried.

The track 81 (FIG. 5) includes a top member 83 and a bottom member 84. The bottom member 84 extends substantially from the front of the head 29 to the back of the head 29. The top member 83 is longer than the bottom member 84 and extends beyond the back of the head 29. The top member 83 has a top surface 85 and two side walls 87. A plurality of rollers 89 are rotatably mounted in the track top member 83 and extend inwardly from the top member side walls 87. The bottom member 84 has a bottom surface 91 to which the heating unit housing 61 is secured by any conventional means, such as by bolts, screws, welding, etc. A pair of side walls 93 extend up from the bottom surface 91 and have outwardly extending flanges 95. As seen in FIG. 5, the flanges 95 ride on the rollers 89. A handle 97 extends forwardly from the front of the track bottom member 84 to facilitate extension and retraction of the heating unit 29. The handle 97 is mounted to a face plate 96 which extends between the side rails 93 of the carriage bottom member 84. A second handle 100 extends upwardly from the carriage top member 83 to facilitate pivoting of the head 29 on the column 27. The handles 97 and 100 are each made of materials which are poor conductors of heat so that they will not get too hot during use of the heating unit 21.

The track lower member 84 does not extend all the way to the back of the track upper member 83, and the track upper member is closed at its bottom 99 beyond the back of the electrical housing 73, as seen in FIG. 6. A neck 101 extends from the bottom 99. The neck 101 is rotatably received in the top of the upper tube 33. Thus, the heating unit 29 can be pivoted about the stem 27.

A control unit 103 (FIG. 7) can be mounted to the top of the track upper member 84. The control unit 103 includes a plug 105 into which the heating element power cord 77 can be plugged, an on-off switch 107, and a control dial 109. The control unit 103 can be used to control the output (i.e., the temperature) of the heating element 63. The control unit 103 has a power cord 111 to connect the control unit 103, and hence the heater unit 29, to a source of electricity. Preferably, the heating element 63 is optionally connected to the control unit 103 by means of the power cord 77 and the plug 105. However, the heating element 63 can also be directly wired to the control unit 103. This would eliminate the need for the on/off switch 75 on the heating unit 29.

As can be appreciated, the heating unit 21 allows for the height of the head 29 to be easily adjusted. Similarly, the horizontal position of the head 29 can be easily adjusted by rotating the head 29 about the support column 27 and by sliding the head 29 along the track 83. The head 29 thus has three degrees of freedom (i.e., vertical, horizontal pivoting, and lateral). The head 29 can thus be easily adjusted to fit most any table surface.

Figure 10:
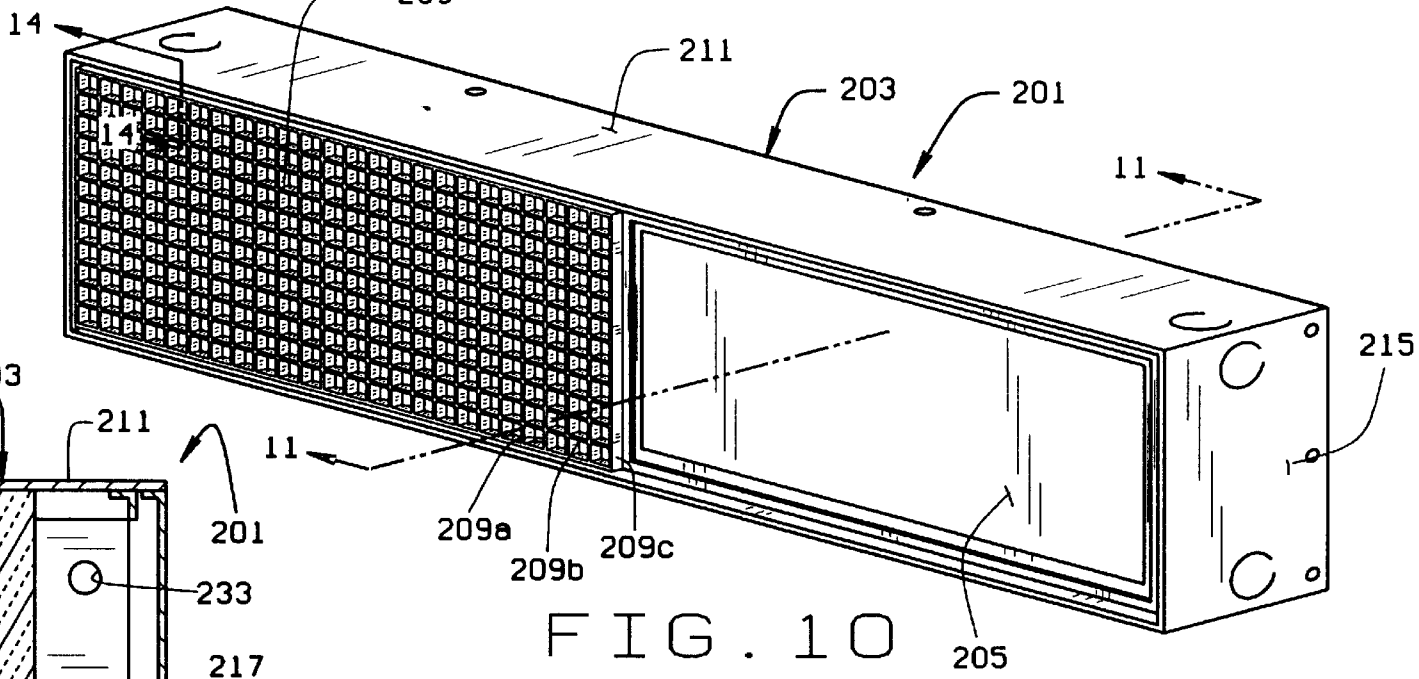
FIG. 10 is a front perspective view of a gangable heater unit incorporating two heating elements of FIG. 1, one of the elements being covered with a focusing grid.
Figure 11:
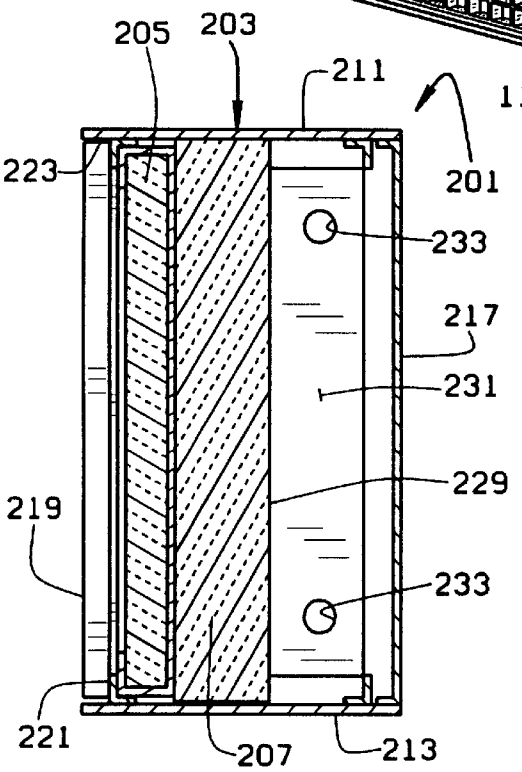
FIG. 11 is a cross-sectional view of the gangable heater unit, taken along line 11—11 of FIG. 10.
Figure 16:
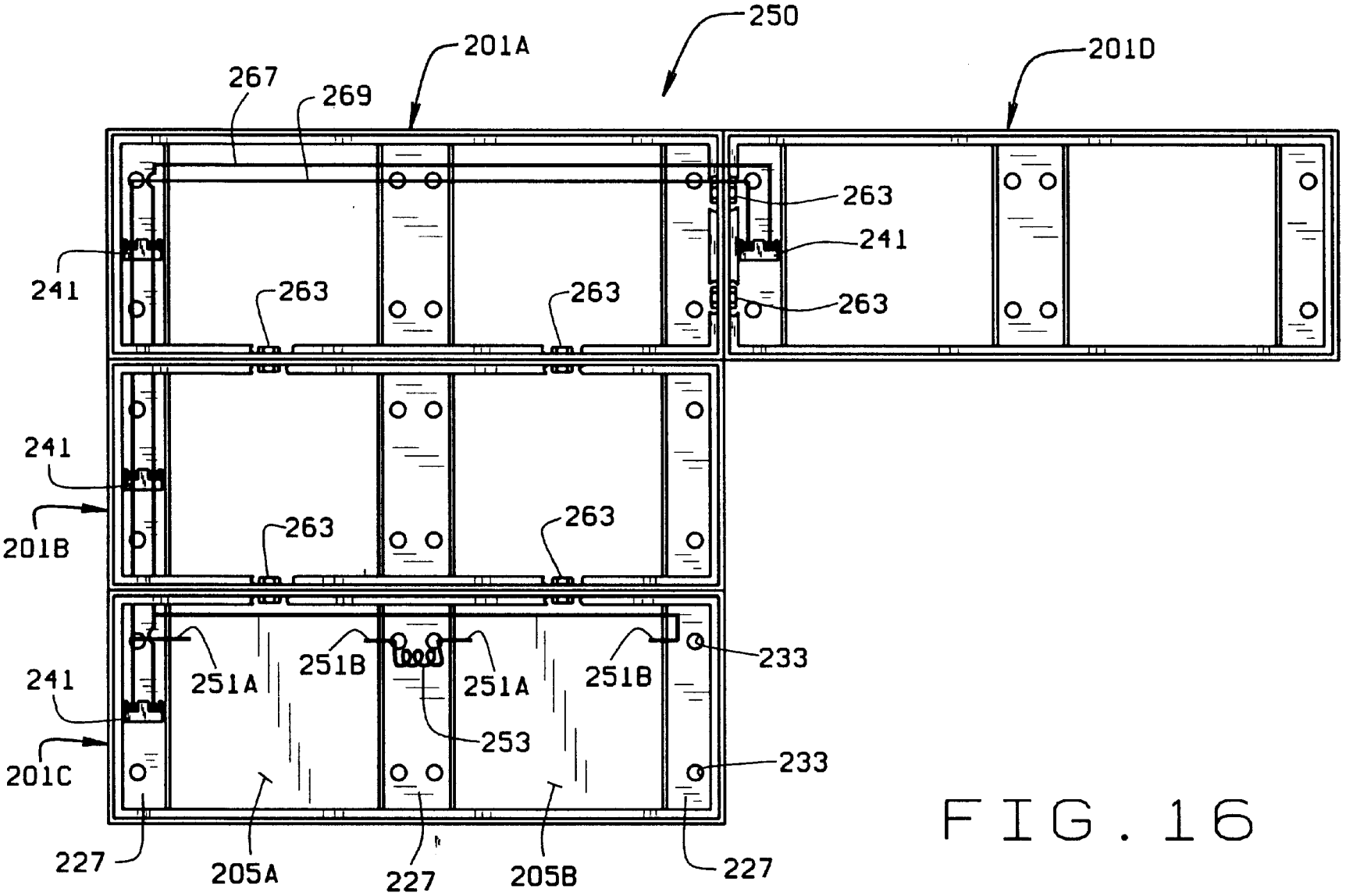
FIG. 16 is a schematic diagram showing a plurality of the heater blocks connected together and the electrical connections therebetween.
Figure 17:
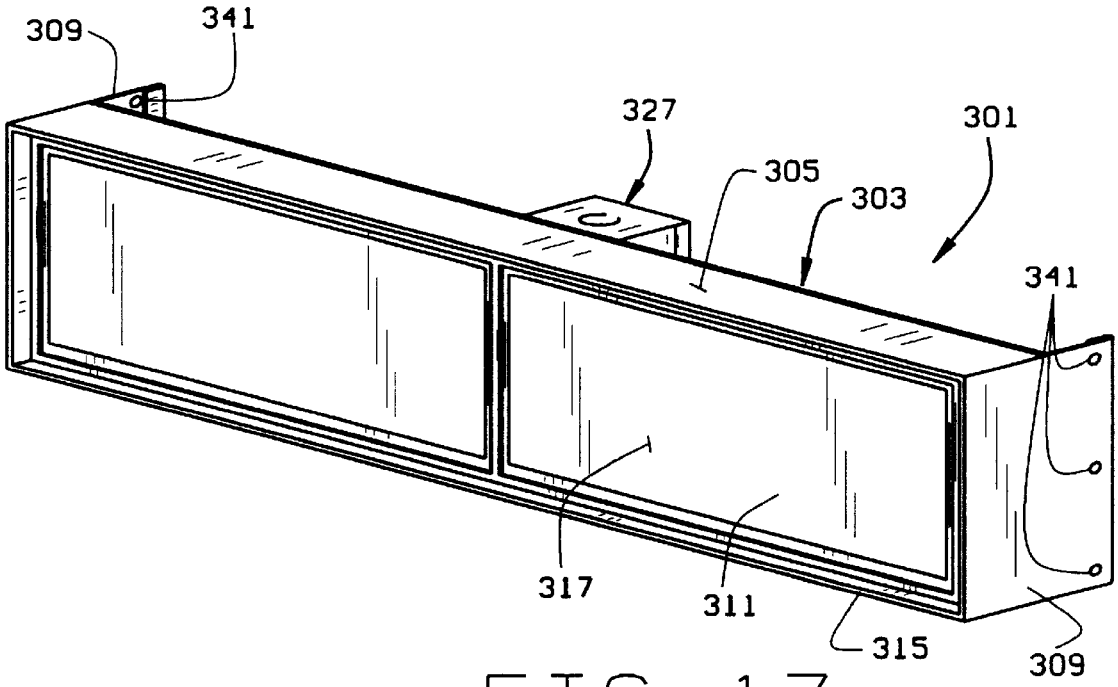
FIG. 17 is a perspective view of a second embodiment of the gangable heater unit.
Figure 18:
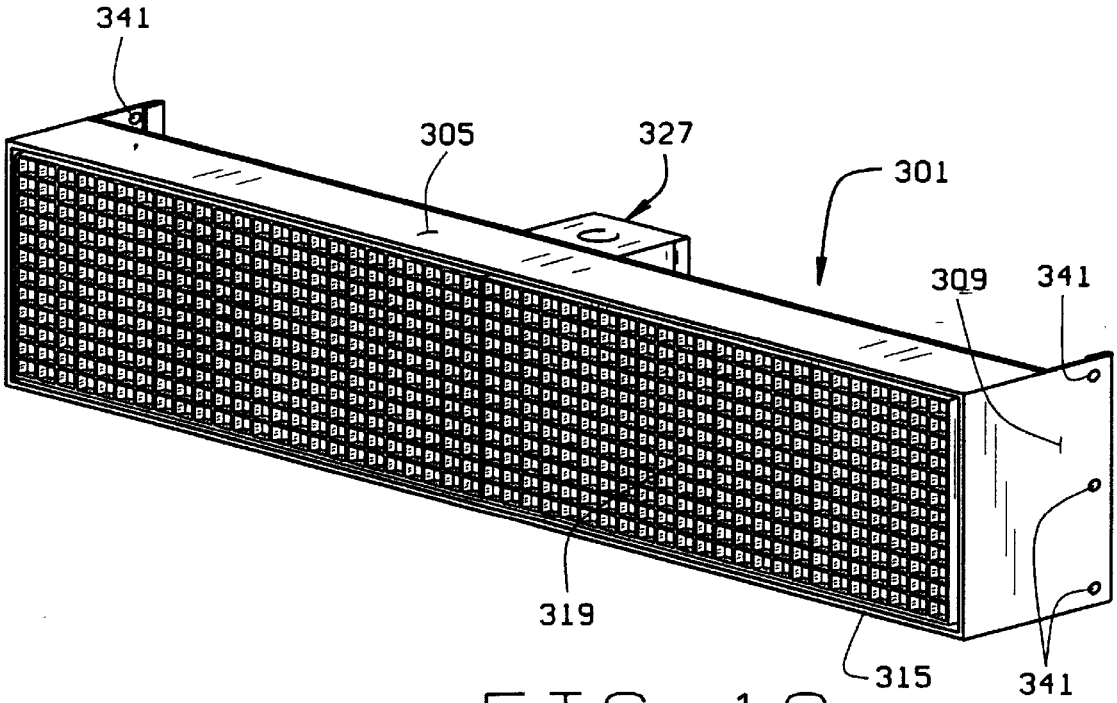
FIG. 18 is a perspective view similar to FIG. 17, but incorporating a focusing grid.
Figure 19:
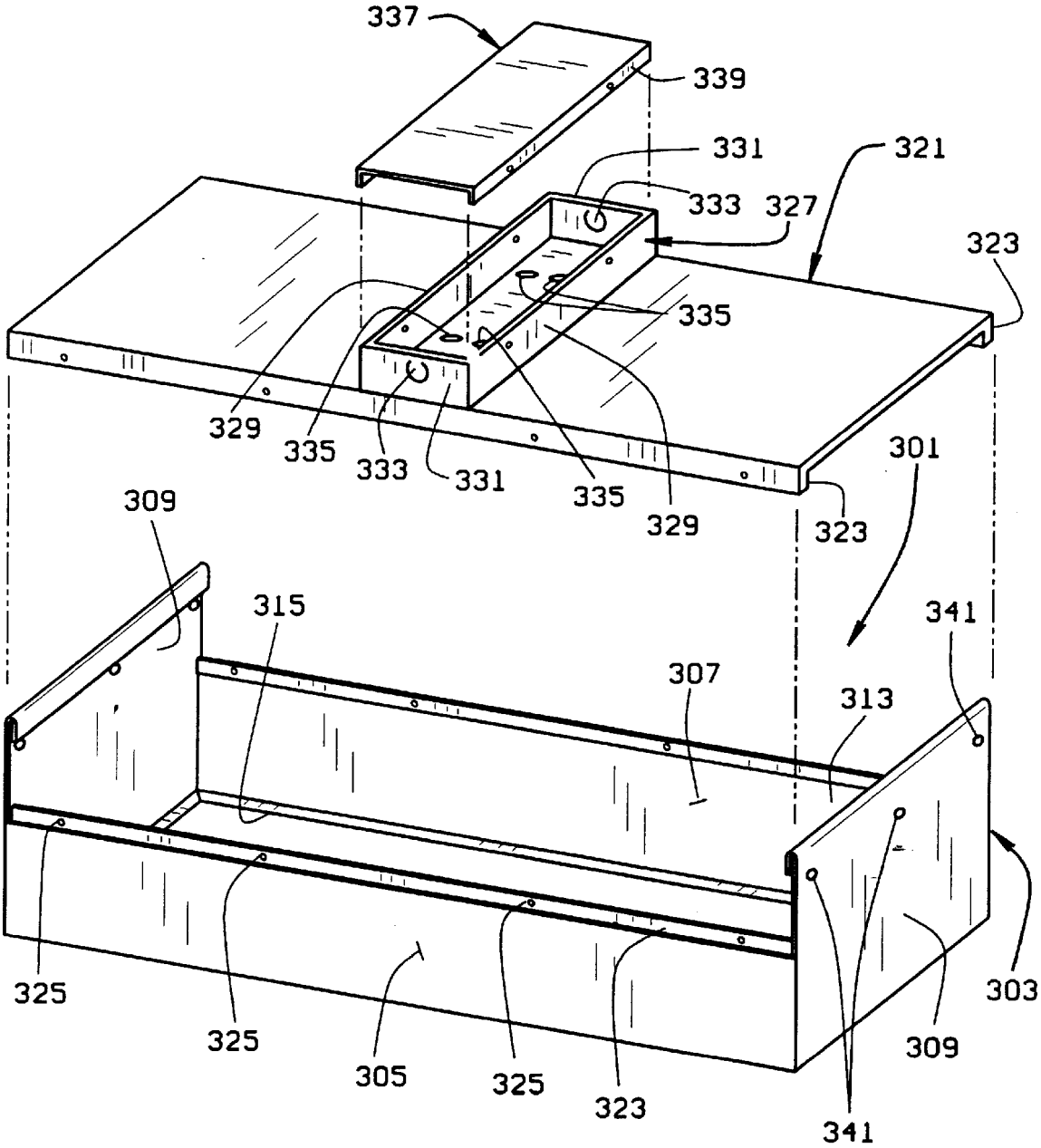
FIG. 19 is an exploded perspective view of the gangable heater unit of FIG. 17.

A heating unit or block 201 is shown generally in FIGS. 10 and 11. The heating block 201, as will be described below, enables a user to construct an array or wall of heating blocks (as shown in FIG. 16) quickly and easily, and without the need for specialized tools. Further, the heating blocks of the array of heating blocks can be electrically connected, thereby reducing the number of controllers needed to control or power the heating blocks in the array.

The heating block 201 includes a housing 203 in which a heating element 205 is mounted. Heating element 205 is preferably a heating element made similarly to heating element 1 of FIGS. 1–3. An insulating layer 207 is placed behind the heating element 205, as will be explained, to hold the heating element in place in the housing 203. A focusing grid 209 can easily be applied to the housing, if desired.

Figure 12:
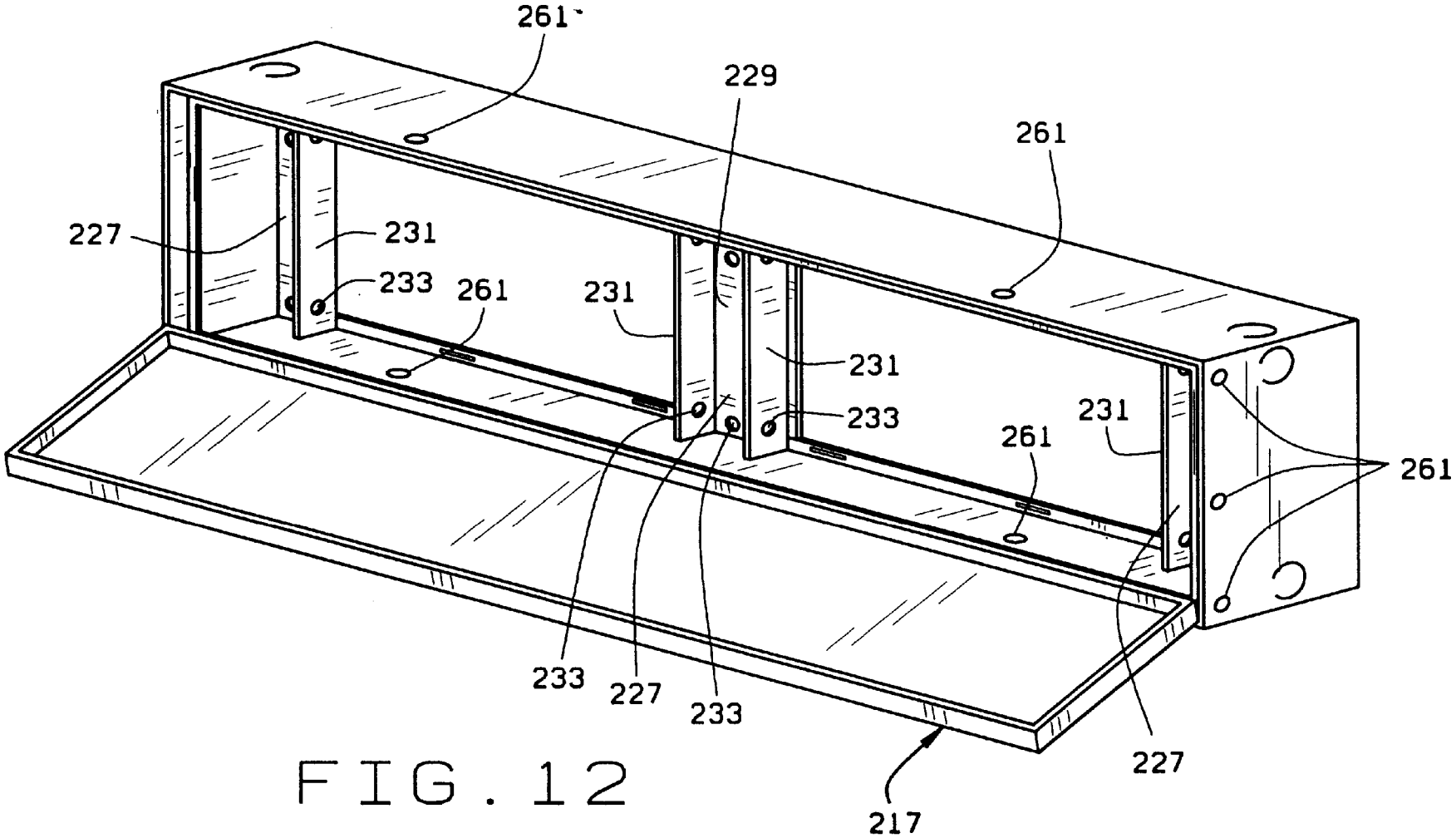
FIG. 12 is a rear perspective view of the gangable heater unit housing, the back of the housing being open.
Figure 13:
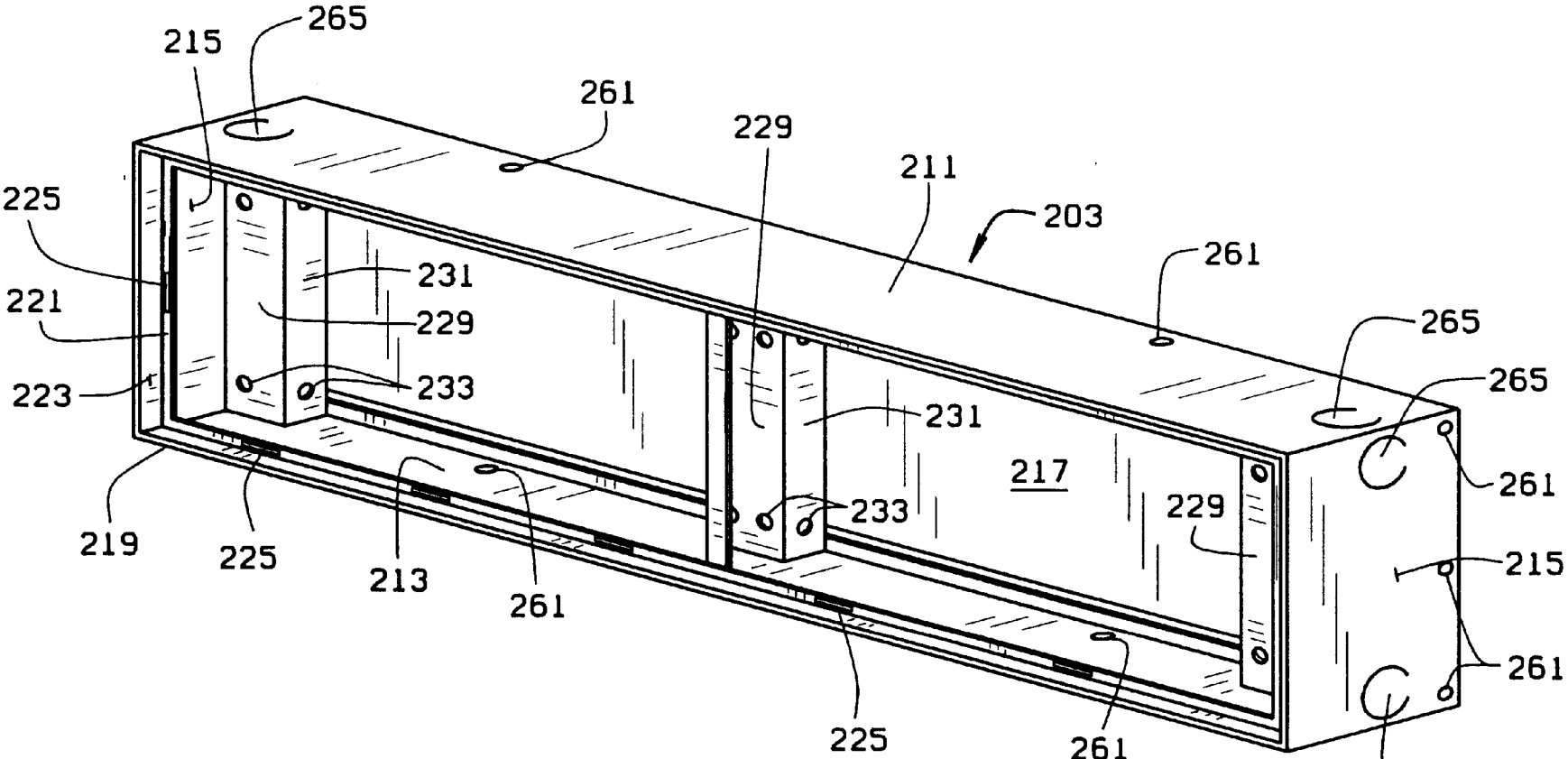
FIG. 13 is a front perspective view of the housing without the heating element installed therein.

The housing 203 includes a top 211, a bottom 213, sides 215, a removable back panel 217, and an open front 219. The removable back panel 217 is hinged, preferably along the bottom of the housing 203, as shown in FIG. 12, to facilitate assembly of individual heating blocks 201, as well as interconnection of the heating blocks to form an array, as shown in FIG. 16. A flange 221, spaced rearwardly slightly from the front opening 219, extends inwardly from the top, bottom, and side walls of the housing. The flange 221 and the top, bottom, and side walls of the housing cooperate to form a lip 223, which is preferably approximately equal to the width of the focusing grid 209. A plurality of elongate slits 225 are formed in the flange 221, and extend parallel to the flange. Lastly, the housing 203 includes a plurality vertical channels 227 positioned between the front 219 and the back 217 of the housing 203. The channels 227 are defined by a front plate 229, and at least one side plate 231. In FIGS. 12 and 13, three channels 227 are shown—one channel is generally centered with respect to the housing 203, and the other two channels are adjacent the side walls 215 of the housing. The two side channels 227 rely on the side walls 215 to form the channel 227. The panels 229 and 231 each have wiring holes 233. The channel front panel 233 is spaced rearwardly from the flange 221, as best seen in FIGS. 11 and 13, and the side panels 231 extend rearwardly from the front panel 229 and have a back edge spaced from the housing back panel 217, as best seen in FIGS. 11 and 12.

Figure 14:
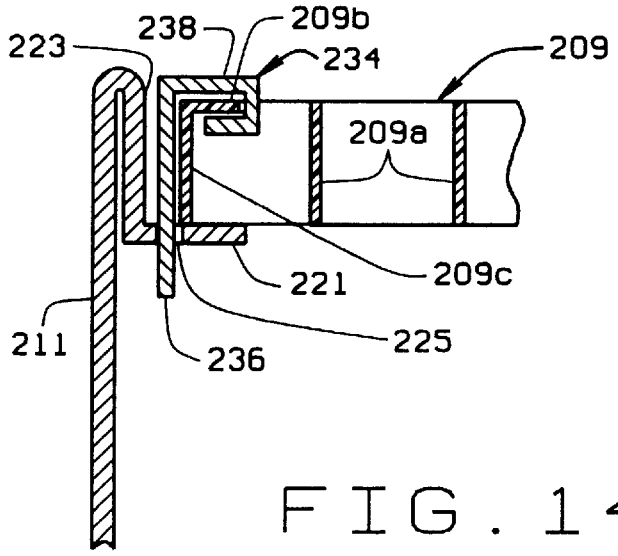
FIG. 14 is an enlarged view taken along line 14—14 of FIG. 10 showing how the focusing grid is held in the housing.
Figure 14A:
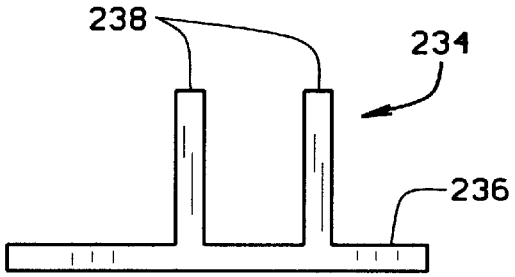
FIG. 14A is a plan view of a clip used to secure the focusing grid to the heater unit housing.

The focusing grid 209 has longitudinal and lateral vanes 209A,B surrounded by a frame 209C and is held in place on the housing by a clip 234 which clips around the vanes to hold the grid 209 to the housing 203. The clip 234 has a base 236 and a pair of spaced apart fingers 238. The base 236 is longer than the slits 225 in the housing lip 221. The clip 234 is inserted in the base so that the clip base 236 is adjacent the back of the flange and the clip fingers 238 extend forwardly through the flange slit to extend above the level of the grid. The fingers 238 are spaced apart a distance so that a longitudinal or lateral grid vane can pass between the fingers. The fingers 238 are then bent over and around a frame or a vane of the grid, as shown in FIG. 14, to hold the grid in place on the heater unit housing. A plurality of clips 234 are used around the periphery of the grid to hold the grid to the housing. As can be appreciated, by using the clips 234, the grid 209 can be attached to the housing 203 without the use of tools.

The housing 203 is preferably rectangular, as shown, and can accommodate one or multiple heating elements 205 (two rectangular heating elements are shown). To assemble the heating block, the heating elements 205 are placed against the back surface of the flange 221. The insulating layer 207 is then used to fill the space between the heating elements 205 and the channel front panels 229. The heating elements 205 and insulating layer 207 are thus simply sandwiched between the flange 221 and the channel front panel 229. The insulating layer 207 is preferably an insulating blanket, such as is sold by Unifrax Corp. under the name DURABLANKET. Such an insulating blanket is resilient, and the natural resiliency of the insulating blanket, when sufficient width of the insulating blanket is placed behind the heating elements 207, will hold the heating elements 205 and the insulating blanket 207 in the housing 203 without the need to use any mounting or securing components or devices.

Figure 15:
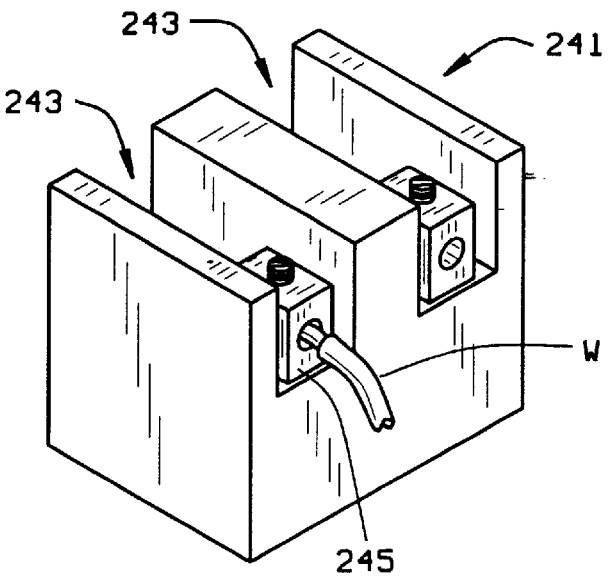
FIG. 15 is a perspective view of a terminal block used in the housing.

A terminal block 241 (shown in FIG. 15) can be mounted to one of the channel front panels 229 within the channel 227 (preferably to one of the front panels adjacent the one of the housing side walls) to aid in electrically connecting the heating elements of a heating unit and to electrically connect multiple heating units. The terminal block 241 has a base made of electrically non-conductive material with a pair of channels 243 formed therein. A wire connector 245 is fixed in each channel 243 to receive a wire W.

In FIG. 16, a plurality of heating units 201A–D are shown as forming an array 250 of heating units. In heating unit 201C, the two heating elements 205A and 205B are shown. Each heating element has two leads 251A,B. The lead 251A of element 205A is connected to one of the connectors of the terminal block 241. The lead 251B of element 205A is connected to element 251A of element 205B by a connector 253. The lead 251B of element 205B is then connected to the other connector of terminal block 241. As can be appreciated, the leads enter and exit the channels 227 through the holes 233 in the channel panels.

The array 250 of heating blocks is formed by physically connecting the housings of the heating blocks. The heating block housing 203 is provided with a plurality of bolt holes or knock-outs 261 (FIG. 12) in the top, bottom, and side walls sized to accept bolts, fasteners, or the like to assemble the units into an array of a desired size. A set of knock-outs 265 are formed in the top, bottom, and side walls of the housing 203 to allow for the passage of electrical wires between adjacent heating units. The knock-outs 265 are positioned on the housing to communicate with the channels 227. To electrically connect the heating blocks 201, the knock outs 265 are removed as necessary, and wires 267 and 269 pass through the knock-outs to electrically connect the connectors of the terminal block of one unit to the terminal block of another unit. Thus, unit 201C is electrically connected to unit 201B; unit 201B is electrically connected to unit 201A; and unit 201D is electrically connected to unit 201A. Unit 201A can then connected to the power supply and controller. As all the units are electrically connected together, only one power supply is necessary and only one controller is needed. Depending on the number of units intended to be interconnected, there may need to be more than one "array" of electrically connected units, to avoid placing too much power consumption on a single controller and power supply. Although the terminal block 241 is shown to make the electrical connections, wire nuts can also be used to make the necessary electrical connections.

As will be appreciated, the heater unit 201 can be easily assembled substantially without the use of tools. Only a screwdriver is needed to secure the wires in the terminal block to electrically connect the heating elements to a source of electricity. Similarly, a plurality of heating units can be easily assembled and electrically connected to form a bank or wall of heating units. Several heating units can be powered from a single power source. This reduces the number of power supplies that are needed to energize and control a wall of heaters. The number of heating units that can be electrically connected is limited by the size of the power supply used.

A second embodiment of the heating block 301 is shown in FIGS. 17–20. The heating block 301 includes a body or box 303 having a top 305, a bottom 307, sides 309, an open front 311, and an open back 313. The front 311 includes a circumferential flange 315. The heating element 317 is placed against the inner surface of the flange 315. If a focusing grid 319 is used, the focusing grid is placed against the inner surface of she flange 315, and the heating element is placed against the focusing grid.

A cover 321 closes the open back 313 of the box 303. The cover 321 extends the full distance between the side walls 309, and has top and bottom lips 323 which overlap the top and bottom of the box 303. Fasteners 325 extend through the lip 323 to secure the cover 321 to the back of the box 303. The cover 321 further includes a wire raceway 327 inside which wire connections are made to electrically connect the heating elements of the heating unit 301 as well as to electrically connect multiple heating units 301. The raceway 327 includes side walls 329 which extend between the top and bottom edges of the back cover 321 and top and bottom walls 331. The top and bottom walls 331 have knock-outs 333 to allow for wires to pass between adjacent heating units 301. The cover 321 includes wire openings 335 within the raceway 327. The leads from the heating elements extend through the openings 335 to be connected together. As can be appreciated, a wire nut can be used to connect the leads from the heating elements. Lastly, a cover 337 is provided to close the raceway 327. The cover has side walls or lips 339 which overlap the side walls 329 of the raceway 327. Fasteners pass through the cover lips 339 and the raceway walls 329 to fix the cover 337 to the raceway.

To assemble a heating unit 301, initially a focusing grid 319 is inserted in the space defined by the box walls to seat against the inner surface of the flanges 315. The heating element is then placed against the back surface of the focusing grid. If a focusing grid is not to be used, then the heating element is placed against the inner surface of the flange 315. The remainder of the inside of the box 303 is filled with an insulating layer, such as a DURABLANKET insulating blanket, as is used in the heater 201. The leads of the heating elements are extended through or around the insulating layer to extend out the back of the insulating layer. The cover 321 is then applied to the back of the box 303 and the leads are passed through the wire holes 335 to extend into the raceway 327. Once the wire leads are connected together, the cover 337 is applied to the raceway 327 to close the raceway. As with the heater unit 201 of FIGS. 10–16, the insulating blanket which is packed between the back cover 321 and the heating element will hold the heating element and the focusing grid (if it is used) in place in the housing. As can be appreciated, because the focusing grid is placed inside the housing, no clips or other fastening hardware is needed to hold the focusing grid to the housing.

Figure 20:
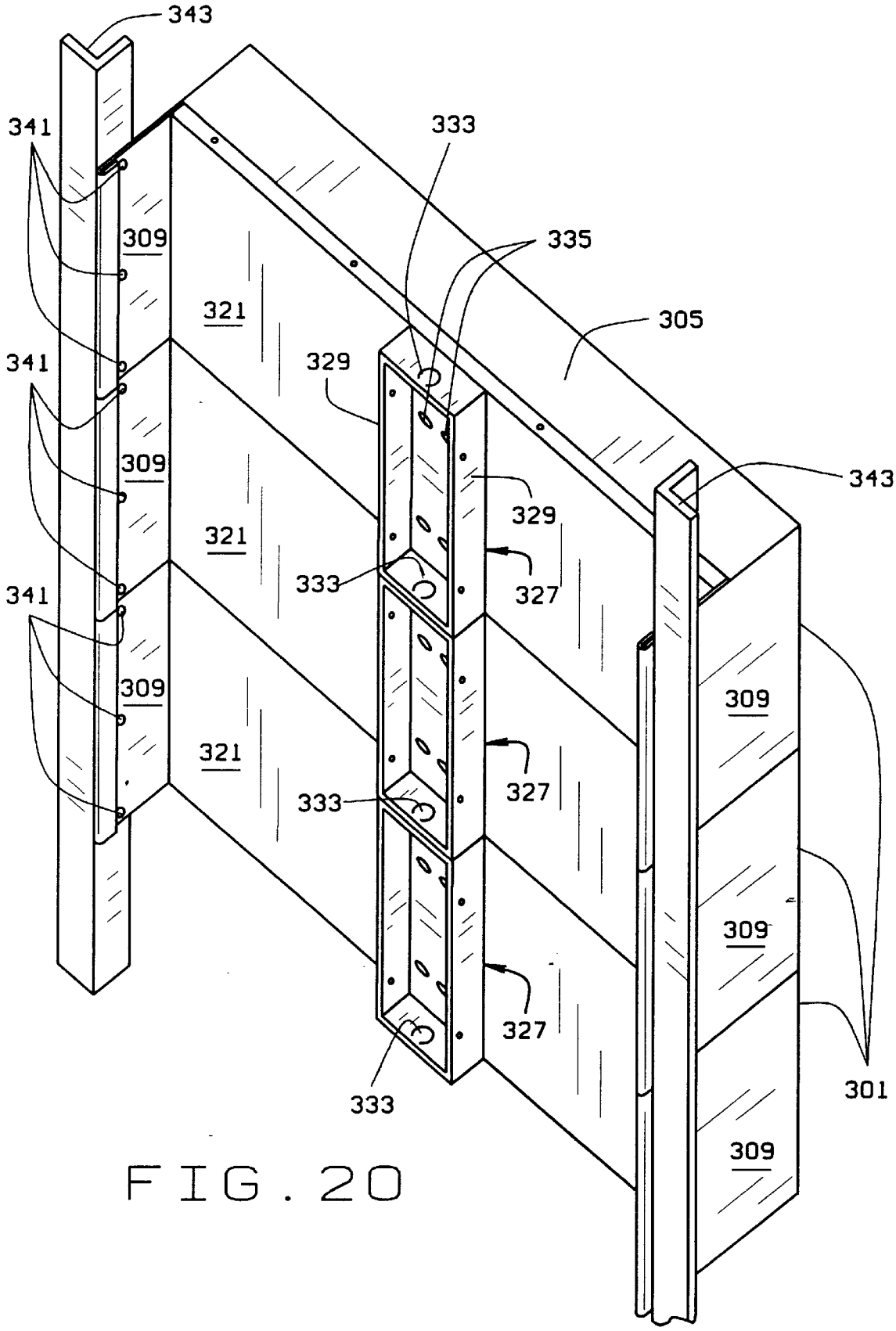
FIG. 20 is a perspective view of three heater units stacked together to be electronically connected, a cover for the wire raceway of the heater units being omitted.

FIG. 20 shows a bank of heating elements 301. As can be seen, the side walls 309 extend rearwardly beyond the top and bottom walls of the box 303. The side walls include mounting holes 341 near the rear edges thereof. The box 303 can then be mounted to upwardly extending support beams 343 by fasteners which extend through the mounting holes 341 and into the support beams 343. The knockouts 333 in the top and bottom walls of the raceways 327 can be removed as necessary to allow for electrical connection of the heating units 301. As can be appreciated, this allows for multiple heating units to be connected without the use of wire conduits and without having any exposed wires.

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense. For example, the terminal blocks 241 of the heating block 201 can be replaced with wire nuts. Although the spring 47 of the heating assembly 21 is connected to the bar 37 and the top tube 33 using pins 45 and 49, respectively, other connection devices could be used to mount the spring 33 in the stem 27. For example, hollow tubes or similar members which are closed at one end could extend from the bar 37 and the top tube 33 to face each other. The spring 33 could then be received in the hollow tubes. This would enable the spring to be compressed by shortening of the stem, but would not allow for expansion of the spring by extension of the stem. These examples are illustrative only.

I claim:

1. An infrared heating element including a facing material having a first surface and a second surface, an insulating layer, and a heating element fixed between the facing material and the insulating layer; the first surface of the facing material defining a heating surface of the heating element when the heating element is assembled;

the insulating layer being made from a flexible insulating blanket; the insulating blanket having a first surface, a second surface, and a core between the first and second surfaces; the flexible blanket being rigidized by the application of a rigidizing solution to at least the first surface of the blanket; the rigidizing solution being absorbed only through a portion of the thickness of the blanket to leave the core of the blanket substantially free of rigidizing solution such that the insulating layer has a first density at the blanket's first surface and a second lesser density at the blanket's core.

2. The heating element of claim 1 wherein a heat resistant adhesive is applied to at least the second surface of the facing material to fix the heating element in place relative to the facing material.

3. The heating element of claim 2 wherein the heating filament is covered with further adhesive to further secure the heating element in place on the facing material and to adhere the insulating layer to the second surface of the facing material.

4. The heating element of claim 1 wherein the facing material comprises a fiberglass cloth.

5. The heating element of claim 2 wherein the adhesive is a refractory fiber.

6. The heating element of claim 1 wherein the heating element is made by adhering the heating element to the facing material and then adhering the insulating blanket to the facing material/heating element assembly; the rigidizing solution is applied to the insulating blanket after the insulating blanket is placed over the heating filament.

7. The heating element of claim 1 wherein rigidizing solution is applied to the second surface of the insulating blanket, and wherein said blanket core remains free of said rigidizing solution.

8. The heating element of claim 1 wherein said rigidizing solution impregnates the insulating blanket from between $1/16^{th}$ to ½ of the width of the insulating blanket.

9. The heating element of claim 1 wherein the heating element is dried after it is assembled.

10. The heating element of claim 1 wherein the heating element has a heating surface; the first surface of the facing material defining the heating surface of the heating element; the heating surface being painted with a high emissivity IR coating.

11. An infrared heating element comprising:

a facing having a first surface and a second surface, said facing first surface defining a heating face of the heating element;

an insulating blanket having a first surface, a second surface, and a core between its first and second surfaces; at least the first surface of the insulating blanket being partially impregnated with a rigidizing solution to make the first surface rigid: the core of the blanket being free of the rigidizing solution; said blanket having a first density at said blanket first surface, and a second, lesser, density at said blanket core; and a heating filament sandwiched between the facing and the insulating blanket.

12. The infrared heating element of claim 11 wherein said insulating blanket is formed from a flexible woven insulating material.

13. The infrared heating element of claim 11 wherein the heating filament is substantially adjacent the facing.

14. The infrared heating element of claim 11 wherein the filament is fixed in place between the facing and the insulating blanket by an adhesive, said adhesive gluing the insulating blanket to the facing.

15. The infrared heating element of claim 14 wherein the adhesive is refractory cement containing silicate fibers.

16. The infrared heating element of claim 11 wherein the facing is a fiberglass cloth, the fiberglass cloth being impregnated with an adhesive.

17. The infrared heating element of claim 11 wherein the second surface of the insulating blanket is adjacent the heating filament.

18. The infrared heating element of claim 17 wherein the second surface of the insulating blanket is impregnated with rigidizing solution to rigidize the blanket, the core of the insulating blanket being substantially free of rigidizing solution.

19. The infrared heating element of claim 18 wherein the blanket absorbs adhesive through its second surface, said absorbed adhesive rigidizing the blanket at the second surface of the blanket.

20. The infrared heating element of claim 18 wherein the insulating blanket comprises a ceramic fiber blanket.

* * * * *